United States Patent [19]

Hollaway

[11] 4,063,729

[45] Dec. 20, 1977

[54] PORTABLE PITCHING MOUND

[76] Inventor: William D. Hollaway, 2000 34th St., N.W., Canton, Ohio 44709

[21] Appl. No.: 784,703

[22] Filed: Apr. 5, 1977

[51] Int. Cl.[2] ..... A63B 71/00

[52] U.S. Cl. ..... 273/25

[58] Field of Search ..... 273/25, 26 R

[56] References Cited

U.S. PATENT DOCUMENTS

| | | | |
|---|---|---|---|
| 2,189,428 | 2/1940 | Love | 273/25 |
| 3,236,520 | 2/1966 | Friedman | 273/26 R |
| 3,479,028 | 11/1969 | Goeders | 273/25 |
| 3,703,285 | 11/1972 | Perry | 273/25 |
| 3,837,646 | 9/1974 | Geoders | 273/25 |

*Primary Examiner*—Richard C. Pinkham

*Assistant Examiner*—T. Brown

*Attorney, Agent, or Firm*—Frease & Bishop

[57] ABSTRACT

A portable pitching mound with a body having a generally convex upper surface and a flat lower surface defined by an arcuate outer edge portion terminating in a chord-like front edge. The upper surface is formed with a flat rear surface area and a parallel flat front surface area offset downwardly of the rear surface area. The front and rear parallel flat surface areas extend, respectively, forwardly and rearwardly from an upstanding shoulder which is parallel with the chord-like front mound edge. The upstanding shoulder is located midway between the chord-like front edge and the arcuate outer edge portion at the rear of the mound.

4 Claims, 7 Drawing Figures

PORTABLE PITCHING MOUND

BACKGROUND OF THE INVENTION

1. Field of the Invention

The invention relates to a portable device which may be used in a baseball playing area to convert a standard baseball field into a smaller size field for junior or little league play; and relates particularly to a pitching mound body which may be placed at a proper distance from home plate for use by youthful players.

2. Description of the Prior Art

Junior and little league baseball games frequently are played at baseball fields laid out in standard size for adult players, and thus must be converted to a reduced size field when youthful players are involved. Normally, such standard fields have no provision for a pitcher's mound for a youth at the proper distance from home plate for a youthful pitcher. Thus, it is desirable to provide a portable pitching mound for such purposes, which mound may be transported to the field and installed prior to a junior or little leaque game. Preferably, such portable mound should conform to the rules regarding the size of the mound and the height of the upraised portion of the mound body where the so-called "rubber" is located. Thus, a depression is provided for receiving the pitcher's toe, the pitcher's heel being received at the back of the depression.

One purpose prior portable pitching mound for use for youth leaque purposes has had a uniformly convex upper surface with the depression for the rubber centrally located. Another has had a circular shape with various flat surfaces converging to a "rubber", location much near the rear than the front of the mound. Examples of such prior devices are shown in U.S. Pat. Nos. 3,479,028 and 3,703,285.

Such prior devices, however, have had a number of shortcomings, including a size or shape with dimensions such that difficulties are involved in transporting the same to or from a playing field where the youthful player is to pitch. Also, the prior portable mounds are not adapted to permit the youthful pitcher to step from the mound to a flat field dirt surface area at the completion of the pitch. Also, the upper surface configuration of prior portable mounds tends to deflect a batted ball striking the mound toward, rather than away from, the youthful pitcher, which may result in injury.

Thus, a need exists for a portable pitching mound for youthful baseball pitchers which may be readily transported to and from and installed at a baseball field, which facilitates the pitcher stepping to a flat playing field ground surface at the completion of a pitch, and which normally deflects a batted ball striking the mound away from the pitcher.

SUMMARY OF THE INVENTION

Objectives of the invention include providing a new portable pitching mound structure or body having a major portion of its outer edge formed as an arc of a circle generally satisfying the required mound dimension in this repsect, but having a substantially reduced dimension from front to rear by providing the mound with a chord-like front edge; providing such a new portable pitching mound which has front and rear offset flat upper surface areas formed in the generally convex upper surface of the mound body; providing such a new mound structure wherein the front and rear flat upper surface areas are offset by a preferably vertically extending shoulder formed parallel with the front chord-like mound edge and located midway between the front chord-like edge and the arcuate edge at the rear of the mound; providing such a new mound structure in which the front and rear upper surface areas have extremities at each side which flare laterally outward from the shoulder; providing such a new mound structure with a generally cylindrically shaped surface extending from the chordlike front edge to the front extremity of the flat front upper surface area; providing such new mound structure with angular flat deflecting surfaces extending in lateral rearward directions from an intersection zone depressed in the body offset below the surface areas defined by the front upper surface area and its connected cylindrical surface portion which extends to the chord-like front edge; and providing such new portable pitching mound structure which achieves the stated objectives in an effective and efficient manner, and which solves problems, satisfies needs that have existed, and obtains the described new results in converting a baseball field for youth play.

These and other objects and advantages may be obtained by the new portable pitching mound structure, the general nature of which may be stated as including a mound body having flat lower and generally convex upper surfaces defined by an arcuate outer edge portion teminating in a straight chord-like front edge; the upper surface being formed with parallel offset front and rear flat surface areas; an upright shoulder having ends and bottom and top edges; the front and rear areas extending, respectively, forwardly and rearwardly from said bottom and top edges; said shoulder being parallel with said front edge and located midway between the front edge and a rear arcuate mound edge portion; the front area having flared extremities at each side extending laterally outward from the shoulder ends to the ends of the front edge; a mound surface area cylindrically-shaped in cross section connecting the front area with said front edge; a first pair of flared vertical walls extending from said flared extremities; the lower ends of said walls intersecting at corners with a first pair of angular flat deflecting surfaces which extend downwardly, rearwardly, outwardly from said corners; the rear area having flared extremities extending outward rearward from the shoulder ends and formed with a second pair of flared vertical walls from the lower ends of which a second pair of angled deflection surfaces extend which intersect with the first pair of angular deflecting surfaces respectively.

BRIEF DESCRIPTION OF THE DRAWING

A preferred embodiment of the invention — illustrative of the best mode in which applicant has contemplated applying the principles — is set forth in the following description and shown in the drawing and is particularly and distinctly pointed out and set forth in the appended claims.

Similar numerals refer to similar parts throughout the various figures of the drawing.

DESCRIPTION OF THE PREFERRED EMBODIMENT

Figures 1, 2, 3, 4, 5, 6, 7:
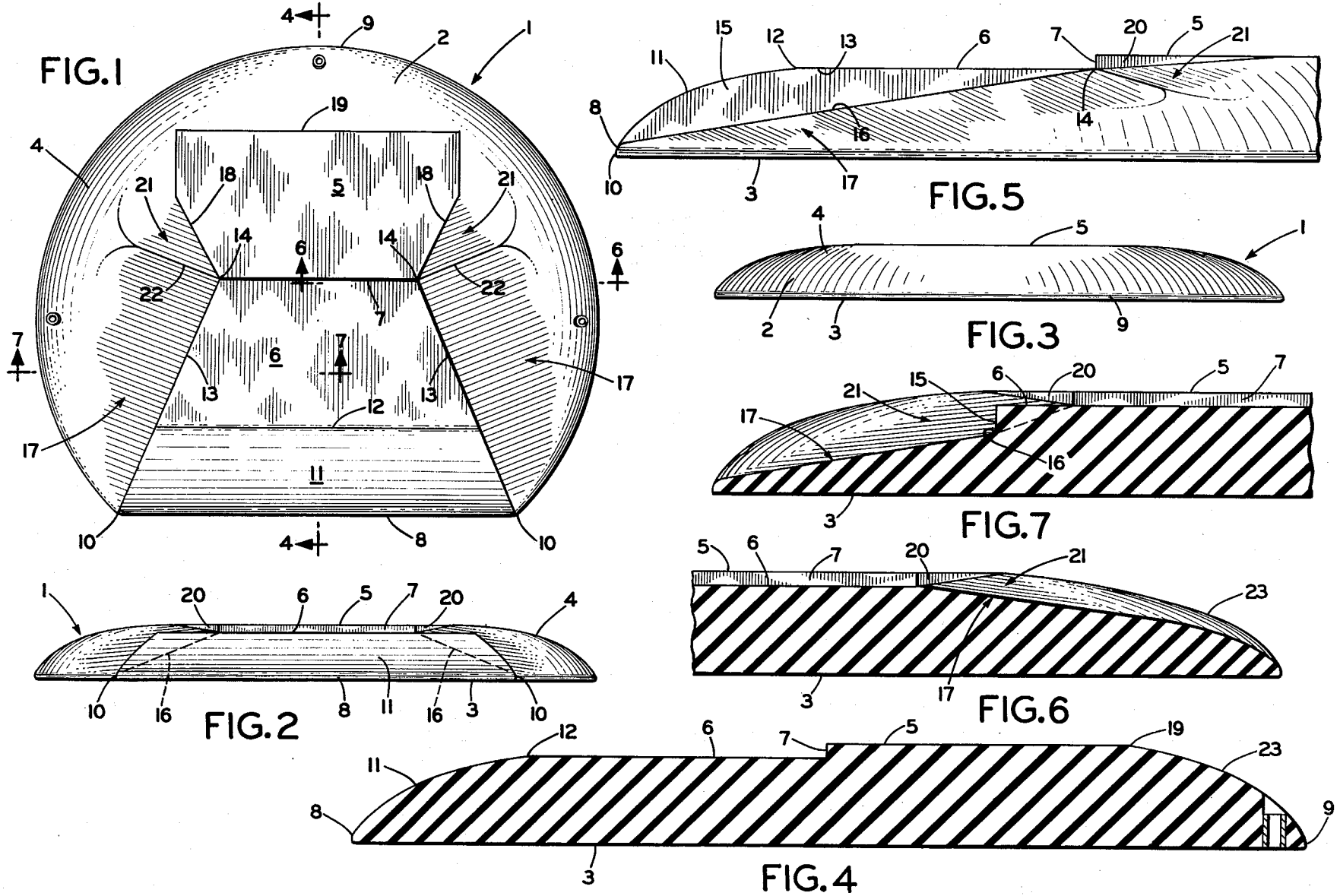
FIG. 1 is a top plan view of the new portable pitching mound.
FIG. 2 is a front elevation looking toward the front chord-like edge portion of the mound body.
FIG. 3 is a rear elevation of the mound.
FIG. 4 is a cross-sectional view on an enlarged scale taken on the line 4—4, FIG. 1.
FIG. 5 is a fragmentary right side elevation of the front portion of the mound on the same scale as and looking in the same direction as FIG. 4.
FIG. 6 is a fragmentary sectional view on the same scale as FIGS. 4 and 5 looking in the direction of the arrows 6—6, FIG. 1.
FIG. 7 is a fragmentary sectional view of the same scale as FIGS. 4, 5 and 6, looking in the direction of the arrows 7—7, FIG. 1.

The new pitching mound generally indicated at 1 may be formed of any suitable material, preferably by molding of a rubber or plastic composition. The mound body 2 has a lower surface 3 and a generally convex upper surface 4. The mound body 2 has a rear flat surface area 5 and a parallel front flat surface area 6 formed in the upper surface 4.

The front flat area 6 is offset downward below the rear flat area 5 (FIG. 4). The offset is provided by the preferably vertically extending shoulder 7 which is parallel with the chord-like front edge 8 of the body 2. The rear flat and front flat surface areas 5 and 6 extend, respectively, rearwardly and forwardly from the upstanding shoulder 7 as well shown in FIGS. 1, 4 and 5. The upstanding shoulder 7, as shown in FIGS. 1 and 4, is located midway between the chord-like front edge 8 and the rear portion of the arcuate outer edge 9 of the body 2.

The major portion of the perimeter of the mound body 2 has an arcuate or circular shape, as shown. The arcuate edge 9 of the perimeter of the body 2 terminates at corners 10 which locate the intersection of the arcuate edge 9 with the ends of the straight chord-like front edge 8 of the body 2. A wall portion of the body 2 extending from the straight chord-like front edge 8, from corner to corner 10 and upwardly to the front flat area 6 has a surface contour 11 generally cylindrically shaped in cross section which merges generally tangentially at 12 with the front flat area 6.

As shown in FIG. 1, the front flat area 6 has extremities 13 at each side which flare laterally outward from the ends 14 of the shoulder 7. The extremities 13 extend to corners 10 of the chord-like front edge 8 of the mound body 2. These flaring end portions 13 of the front flat areas 6 also form the lateral ends of the cylindrical contour 11 of the body 2. Thus, as shown in FIG. 1, the front edge 8, the merger zone 12 and the shoulder 7 are parallel with each other and are perpendicular to a center line of the body 2 which may be represented by the section line 4—4.

The demension of the body 2 along such center line is considerably less than the diameter of the arcuate perimeter 9 of the body 2. Because of the reduced dimension, the new mound 1 may be placed in the trunk of the average auto or vehicle for transporting to and from a baseball field. If the mound is completely round with the diameter of the edge 9, it is difficult to store such mound in the trunk of an average vehicle.

Accordingly, transportation of the pitching mound 1 from the home of a youthful pitcher for whom one of the portable mounds 1 is provided is simple, and the mound 1 provides uniform and reproduceable playing conditions for such youthful pitcher for all games.

The flaring extremities 13 terminate outwardly in vertical wall portions 15 which substantially reduce the height of the mound laterally at either side of the front flat surface area 6 and the connecting cylindrical portion 11. As shown particularly in FIG. 5, the vertical wall portions 15 terminate at their lower ends in shoulder corners 16 which are formed by the intersection at the corners 16 with angular flat deflecting surfaces 17. The angular deflecting surfaces 17 extend downwardly rearwardly outwardly from the shoulder corners 16, as shown in FIGS. 1, 5, 6 and 7.

The cylindrical contour 11 extending upward from the front straight chord-like edge 8 of the mound body 2 in most cases will deflect a batted ball striking the surface 11 upwardly over the pitcher. Similarly, the angular deflecting surfaces 17 when struck by a batted ball will deflect the ball laterally outward to either side of the mound 1 and away from the pitcher.

The rear flat area 5 of the mound body 2 also flares outwardly rearwardly at its side extremities, as indicated at 18, and preferably terminates rearward of the vertical shoulder 7 at a rear straight edge 19 which is parallel with the shoulder 7. The edges of the flared extremities 18 of the rear flat areas 5 are defined by some small vertical wall areas 20 (FIGS. 3, 5 and 7). Flat angled surface areas 21 extend from the lower ends of the wall areas 20 and intersect at lines 22 with the angular deflecting surfaces 17. The areas 21 also merge with the convex outer contour 23 of the mound at the rear thereof which contour 23 continues around the rear arcuate portion of the body 2 beyond the rear edge 19 of the rear flat surface area 5 (FIGS. 4 and 6).

The vertical shoulder 7 has been described as being located midway between front and rear edge portions of the mound body 2. Thus, shoulder 7 also is located rearwardly of the center of the arcuate edge 9 of the body. This feature permits a relatively large rear flat surface area 5 to be provided where the pitcher may stand preparing to pitch. The location of the shoulder 7 midway of the front and rear mound edges, and the contour of the front surface area 6 which is flat, horizontal, and parallel with the flat lower surface 3 of the mound 2 provides a large area in front of what is in effect the "rubber", on which horizontal area a batted ball striking such area normally will not be deflected upwardly, but will skid along the surface.

Furthermore, shortening the distance from the shoulder 7 or "rubber" to the front edge 8 of the mound body 2 enables the pitcher to step completely from the mound in completing a pitch. Thus, the pitcher avoids landing on a raised or angled or curved mound surface which can interfere with stability or quick reaction for fielding a batted ball.

Accordingly, the new concepts of the invention related to the particular structure and configuration of the portable pitching mound, achieve the objectives stated, avoid difficulties that have been encountered with prior portable pitching mounds, solve problems that have existed, and obtain the new results described.

In the foregoing description, certain terms have been used for brevity, clearness and understanding; but no unnecessary limitations are to be implied therefrom beyond the requirements of the prior art, as such terms are used for descriptive purposes and are intended to be broadly construed.

Moreover, the description and illustration of the invention is by way of example, and the scope of the invention is not limited to the exact details shown or described.

Having now described the features and principles of the invention, the manner in which the new portable pitching mound is constructed and used, and the advan-tageous, new and useful results obtained; the new and useful structures, devices, arrangements, and structural relationships are set forth in the appended claims.

I claim:

1. Portable pitching mound construction including a mound body having flat lower and generally convex upper surfaces defined by an arcuate outer edge portion terminating in a straight chord-like front edge; the upper surface being formed with parallel offset front and rear flat surface areas which are also parallel with the lower mound body surface; an upright shoulder having ends and bottom and top edges; the front and rear areas extending respectively forwardly and rearwardly from said bottom and top edges; said shoulder being parallel with said front edge and located midway between the front edge and a rear arcuate mound edge portion; the front area having flared extemities at each side extending laterally outward from the shoulder ends to the ends of the front edge; and a mound surface area cylindrically shaped in cross section connecting the front area with said front edge.

2. The construction defined in claim 1 in which a first pair of flared vertical walls extends from said flared extemities; and in which the lower ends of said first walls intersect at corners with a first pair of angular flat deflecting surfaces which extend downwardly, rearwardly, and outwardly from said corners.

3. The construction defined in claim 1 in which the rear area has flared extremities at each side extending laterally outward rearwardly from the shoulder ends; in which the rear flared extremities are formed with a second pair of flared vertical walls; and in which a second pair of angled deflecting surfaces extend from the lower ends of said second flared vertical walls.

4. The construction defined in claim 1 in which a first pair of flared vertical walls extends from said flared extremities; in which the lower ends of said first walls intersect at corners with a first pair of angular flat deflecting surfaces which extend downwardly, rearwardly, and outwardly from said corners; in which the rear area has flared extremities at each side extending laterally outward rearwardly from the shoulder ends; in which the rear flared extremities are formed with a second pair of flared vertical walls; in which a second pair of angled deflecting surfaces extend from the lower end of said second flared vertical walls; and in which the second pair of angled deflecting surfaces intersect with the first pair of angular deflecting surfaces.

* * * * *